US010443481B2

(12) United States Patent
Yoshida et al.

(10) Patent No.: US 10,443,481 B2
(45) Date of Patent: Oct. 15, 2019

(54) COOLING APPARATUS FOR VEHICLE

(71) Applicant: SUBARU CORPORATION, Tokyo (JP)

(72) Inventors: Shogo Yoshida, Tokyo (JP); Takuya Takashima, Tokyo (JP); Yo Masuda, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 177 days.

(21) Appl. No.: 15/782,117

(22) Filed: Oct. 12, 2017

(65) Prior Publication Data

US 2018/0128155 A1 May 10, 2018

(30) Foreign Application Priority Data

Nov. 9, 2016 (JP) ..... 2016-218674

(51) Int. Cl.
*F01P 7/14* (2006.01)
*F01P 7/04* (2006.01)
(Continued)

(52) U.S. Cl.
CPC ..... *F01P 7/14* (2013.01); *F01P 7/04* (2013.01); *F01P 7/08* (2013.01); *F01P 11/16* (2013.01);
(Continued)

(58) Field of Classification Search
CPC ..... F01P 7/14; F01P 7/04; F01P 7/08; F01P 11/16; F01P 7/048; F01P 2025/08; F01P 2025/30
See application file for complete search history.

(56) References Cited

U.S. PATENT DOCUMENTS 7,398,745 B1 * 7/2008 White ..... F01P 5/14 123/41.01
2002/0195068 A1 * 12/2002 Ichinose ..... F01P 11/14 123/41.14
(Continued)

FOREIGN PATENT DOCUMENTS

JP H06-117259 A 4/1994
JP 2008-215183 A 9/2008
(Continued)

OTHER PUBLICATIONS

Japanese Office Action dated Sep. 4, 2018 for JP Patent Application No. 2016-218674 (4 pages in Japanese with English translation).

*Primary Examiner* — Syed O Hasan
(74) *Attorney, Agent, or Firm* — Smith, Gambrell & Russell, LLP

(57) ABSTRACT

A cooling apparatus for vehicle includes a cooling system, a coolant pump, and a diagnostic controller. The cooling system includes a cooling circuit in which a coolant circulates. The coolant pump causes the coolant to circulate in the cooling circuit. The diagnostic controller diagnoses an abnormality of the cooling system on a basis of a coolant temperature. The diagnostic controller performs a first mode process that increases the coolant temperature by stopping the coolant pump, and a second mode process that causes the coolant temperature to fluctuate periodically by driving the coolant pump. Upon the second mode process, the diagnostic controller diagnoses that the cooling system is normal on a condition that a cycle of the fluctuation of the coolant temperature is shorter than a reference time, and diagnoses that the cooling system is abnormal on a condition that the cycle of the fluctuation is longer than the reference time.

20 Claims, 9 Drawing Sheets

(51) Int. Cl.
*F01P 7/08* (2006.01)
*F01P 11/16* (2006.01)

(52) U.S. Cl.
CPC ..... *F01P 7/048* (2013.01); *F01P 2025/08* (2013.01); *F01P 2025/30* (2013.01); *F01P 2050/22* (2013.01); *F01P 2050/24* (2013.01)

(56) References Cited

U.S. PATENT DOCUMENTS

2012/0085157 A1* 4/2012 Nishigaki ..... G01M 15/042 73/114.68
2012/0330496 A1* 12/2012 Eser ..... F01P 11/16 701/30.8
2013/0213600 A1* 8/2013 Saitoh ..... F01P 7/165 165/11.1
2016/0258343 A1* 9/2016 Mushiga ..... F01P 5/12

FOREIGN PATENT DOCUMENTS

JP 2010-007569 A 1/2010
JP 2015-059458 A 3/2015

* cited by examiner

COOLING APPARATUS FOR VEHICLE

CROSS-REFERENCE TO RELATED APPLICATIONS

The present application claims priority from Japanese Patent Application No. 2016-218674 filed on Nov. 9, 2016, the entire contents of which are hereby incorporated by reference.

BACKGROUND

The technology relates to a cooling apparatus for vehicle that cools a heat-generating component.

A vehicle including an automobile is mounted with a heat-generating component such as an inverter, a converter, a motor-generator, and an engine. In order to cool the heat-generating component to a temperature within a predetermined temperature range, the vehicle is provided with a cooling system that cools the heat-generating component by circulating a coolant. To detect an abnormality of the cooling system, such as leakage of liquid from a pipe line, a radiator, or any other member of the cooling system, a device has been proposed that diagnoses presence of the abnormality on the basis of an increase in temperature of the coolant, by detecting an excessive increase in temperature of the coolant by means of a temperature sensor. For example, reference is made to Japanese Unexamined Patent Application Publication No. 2015-59458.

SUMMARY

An abnormality of a cooling system is not limited only to leakage of liquid from a member such as a pipe line and a radiator. Possible examples of the abnormality may also include clogging of the member such as the pipe line and the radiator resulting from a foreign substance, freezing, or any other factor that may possibly cause the clogging. The clogging generated in the pipe line or any other member narrows a flow channel and thus decreases a circulation flow rate of a coolant. It has been, however, difficult to detect the decrease in the circulation flow rate at an early stage on the basis of an increase in temperature of the coolant.

It is desirable to provide a cooling apparatus for vehicle that is able to diagnose an abnormality of a cooling system at an early stage.

An aspect of the technology provides a cooling apparatus for vehicle. The apparatus includes: a cooling system that cools a heat-generating component by a coolant, and includes a cooling circuit in which the coolant circulates; a coolant pump that is provided in the cooling circuit, and causes the coolant to circulate in the cooling circuit; and a diagnostic controller that diagnoses an abnormality of the cooling system on a basis of a coolant temperature of the coolant that cools the heat-generating component. The diagnostic controller performs a first mode process and a second mode process. The first mode process increases the coolant temperature by stopping the coolant pump. The second mode process is performed after the first mode process is performed and causes the coolant temperature to fluctuate periodically by driving the coolant pump. The diagnostic controller, upon the second mode process, makes a diagnosis that the cooling system is normal on a condition that a cycle of the fluctuation of the coolant temperature is shorter than a reference time, and makes a diagnosis that the cooling system is abnormal on a condition that the cycle of the fluctuation of the coolant temperature is longer than the reference time.

DETAILED DESCRIPTION

[Configuration of Cooling Apparatus for Vehicle]

Figure 1:
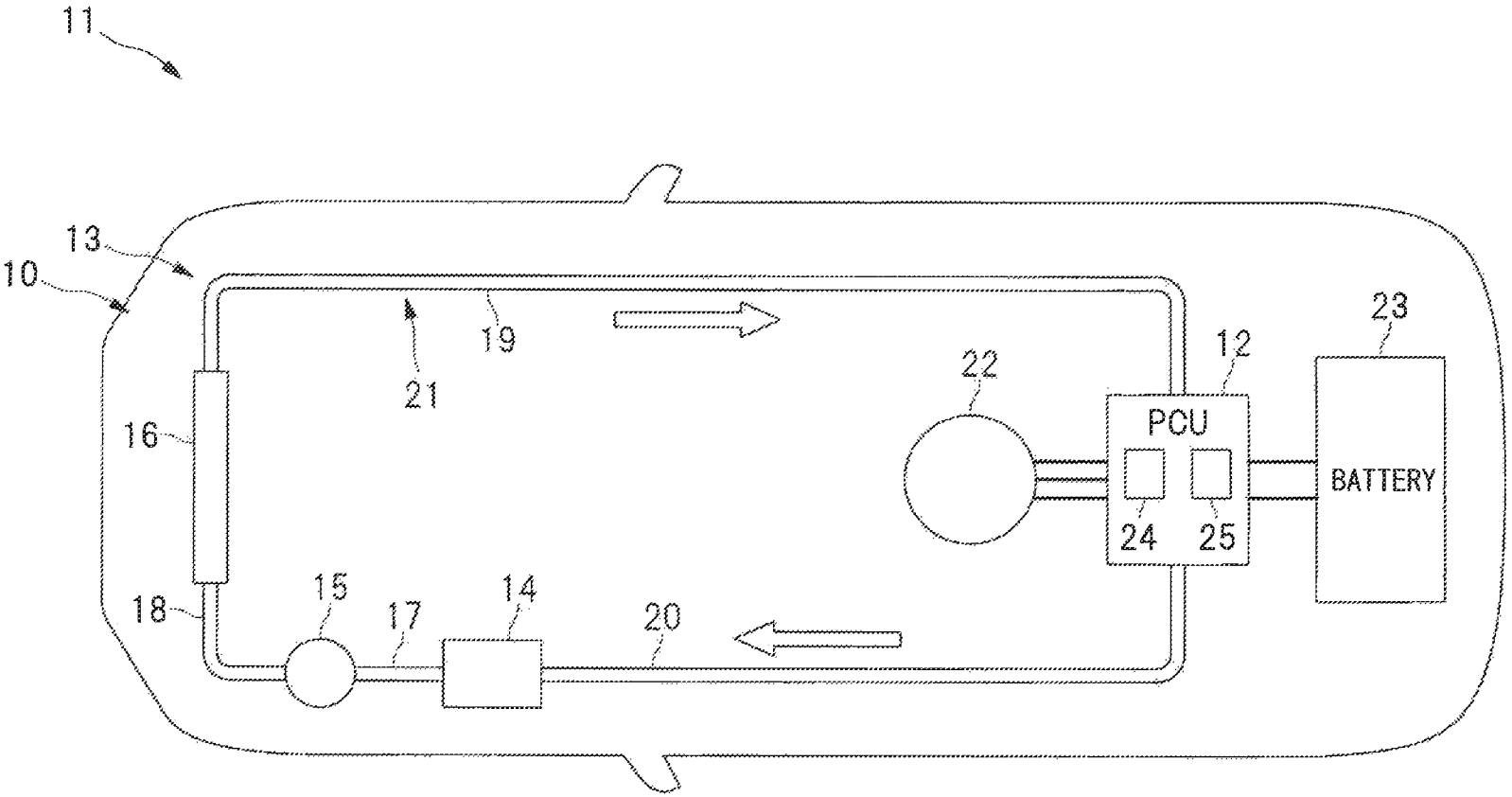
FIG. 1 schematically illustrates an example of a configuration of a cooling apparatus for vehicle according to one implementation of the technology.

In the following, a description is given in detail of one implementation of the technology with reference to the accompanying drawings. FIG. 1 schematically illustrates an example of a configuration of a cooling apparatus for vehicle 10 according to one implementation of the technology, in which an outline arrow denotes a direction of flow of a coolant.

Referring to FIG. 1, a vehicle 11 may be mounted with the cooling apparatus for vehicle 10 according to one implementation of the technology. For example, the vehicle 11 may be a hybrid vehicle. The cooling apparatus for vehicle 10 includes a cooling system 13 that cools a power control unit (hereinafter referred to as "PCU") 12. The cooling system 13 may include a reservoir tank 14 that retains the coolant, a water pump 15 that causes the coolant to circulate, a radiator 16 that cools the coolant, and the PCU 12. In one implementation, the water pump 15 may serve as a "coolant pump". In one implementation, the PCU 12 may serve as a "heat-generating component". The reservoir tank 14, the water pump 15, the radiator 16, and the PCU 12 may be coupled in series to one another through pipe lines 17 to 20. In other words, in one implementation, the cooling system 13 may have a cooling circuit 21 that includes the reservoir tank 14, the water pump 15, the radiator 16, the PCU 12, and the pipe lines 17 to 20.

The water pump 15 may be driven to suck the coolant from the reservoir tank 14 to the water pump 15 and feed the coolant from the water pump 15 to the radiator 16. The coolant having been cooled by traveling through the radiator 16 may be fed to the PCU 12 (i.e., to an unillustrated water jacket of the PCU 12) to cool the PCU 12, following which the coolant may be fed again to the reservoir tank 14. Thus, driving the water pump 15 allows the coolant to circulate along the cooling circuit 21 and thereby allows for continuous cooling of the PCU 12. For example, the water pump 15 may be an electric pump driven by an unillustrated electric motor.

The PCU 12 may electrically couple a motor-generator 22 and a battery 23 together, and may have built-in power conversion devices such as an inverter 24 and a converter 25. Upon a power-running operation of the motor-generator 22, a DC (direct current) current outputted from the battery 23 may be boosted by the converter 25, following which the boosted DC current may be converted into an AC (alternating current) current by the inverter 24. The thus-converted AC current may be supplied to the motor-generator 22 as a high-voltage AC current. Upon a regenerative operation of the motor-generator 22, an AC current outputted from the motor-generator 22 may be converted into a DC current by the inverter 24, following which the converted DC current may be stepped down by the converter 25. The thus-stepped-down DC current may be supplied to the battery 23 as a low-voltage DC current. The inverter 24 and the converter 25 each may include a switching device that generates heat upon conduction of electric power, such as an insulated-gate bipolar transistor (IGBT).

[Control System]

Figure 2:
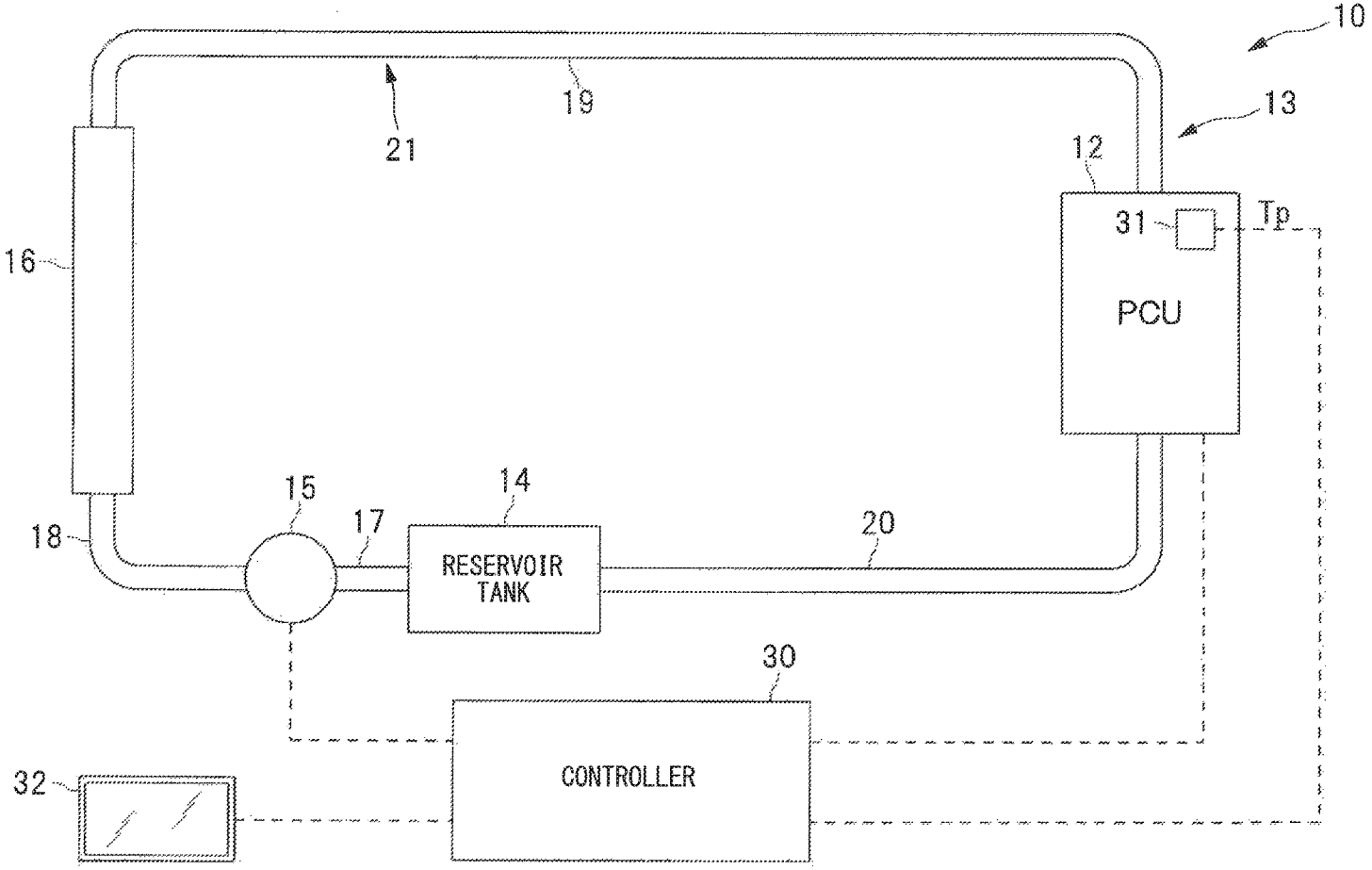
FIG. 2 schematically illustrates an example of a configuration of a control system provided in the cooling apparatus for vehicle illustrated in FIG. 1.

A description is now given of a control system of the cooling apparatus for vehicle 10. FIG. 2 schematically illustrates an example of a configuration of the control system provided in the cooling apparatus for vehicle 10. Referring to FIG. 2, the cooling apparatus for vehicle 10 includes a controller 30 that controls the cooling system 13. The controller 30 may include a computer or any other device that allows for a control of the cooling system 13. The controller 30 may be coupled to a temperature sensor 31 that detects a temperature of the coolant flowing through the PCU 12 (hereinafter referred to as a coolant temperature Tp). The temperature sensor 31 may be provided inside a housing of the PCU 12. The controller 30 may also be coupled to a display that displays, to an occupant, various pieces of information on the cooling system 13.

The controller 30 may control a rotation speed of the water pump 15 on the basis of the coolant temperature Tp to thereby cause the coolant temperature Tp, equivalent to a temperature of the PCU 12, to fall within a predetermined temperature range. For example, the controller 30 may decrease the coolant temperature Tp by increasing the rotation speed of the water pump 15 and thereby increasing a circulation flow rate of the coolant in a case where the coolant temperature Tp is high. In a case where the coolant temperature Tp is low, the controller 30 may increase the coolant temperature Tp by decreasing the rotation speed of the water pump 15 and thereby decreasing the circulation flow rate of the coolant. The controller 30 also has a function of diagnosing an abnormality of the cooling system 13 as described later in greater detail. In one implementation, the controller 30 may serve as a "diagnostic controller". The controller 30 may perform an abnormality diagnosing control upon traveling of the vehicle 11 during which the PCU 12 generates heat.

[Abnormality Diagnosing Control]

Figure 3:
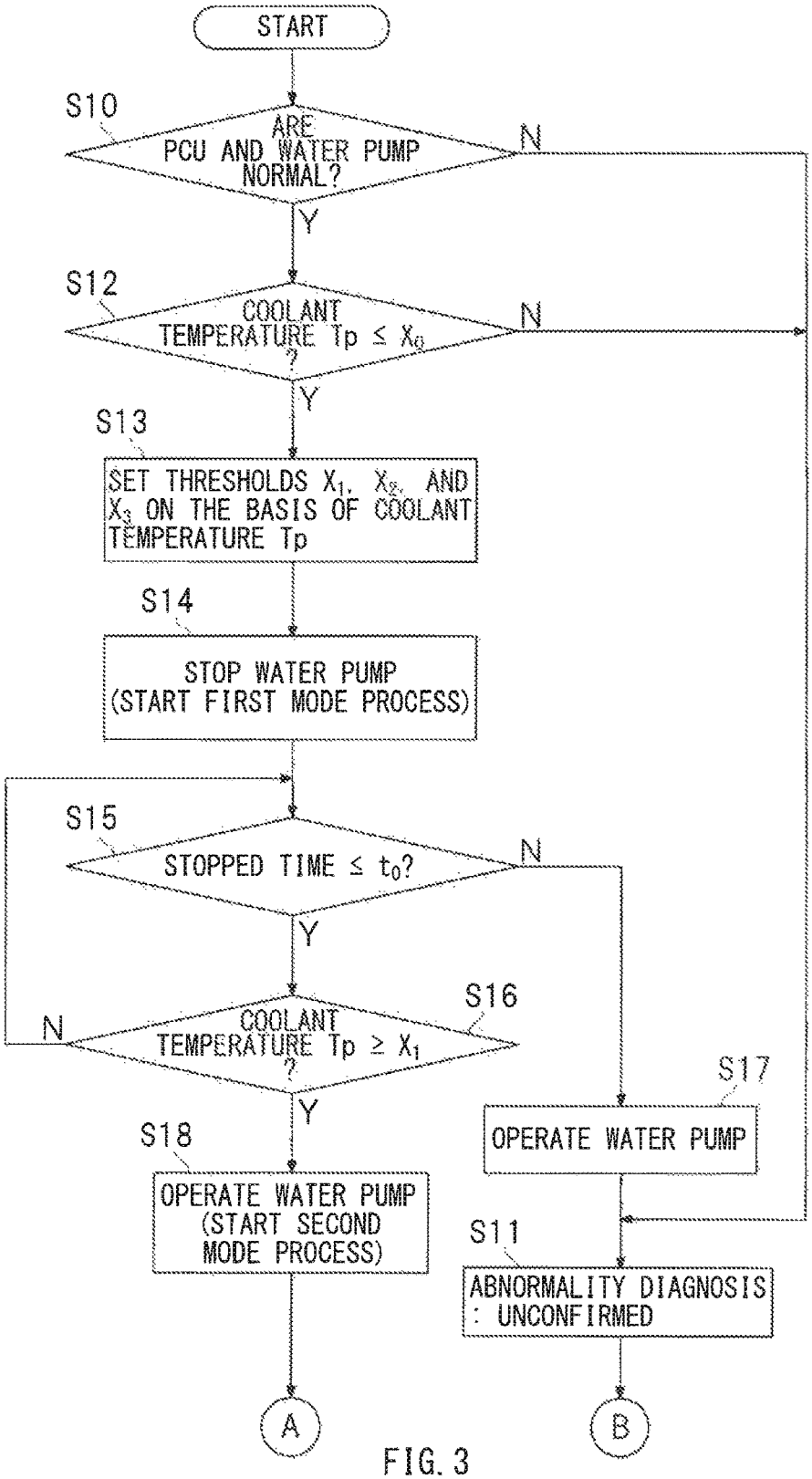
FIG. 3 is a flowchart illustrating one example of a procedure for carrying out an abnormality diagnosing control.
Figure 4:
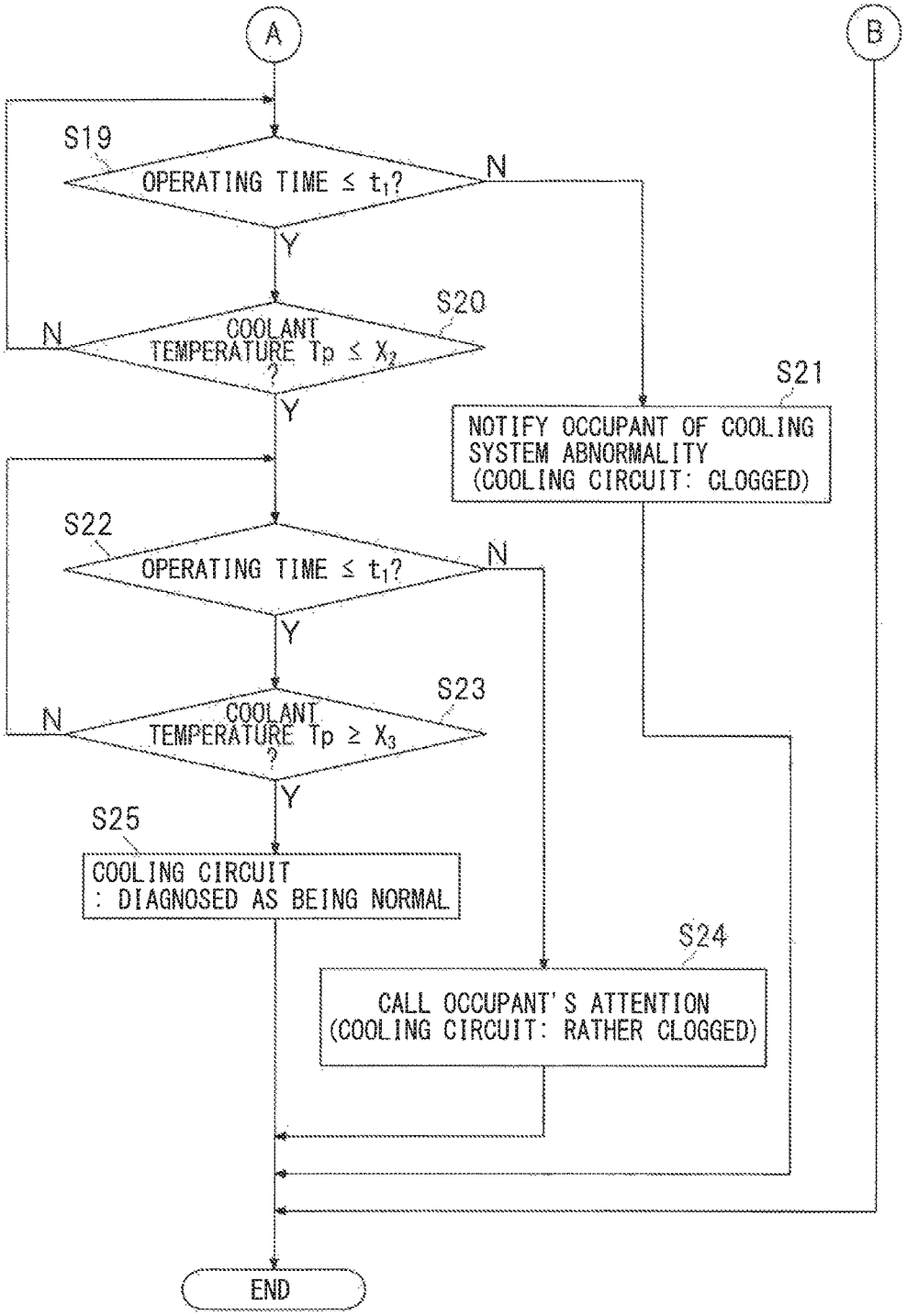
FIG. 4 is a flowchart illustrating one example of the procedure for carrying out the abnormality diagnosing control.
Figure 5:
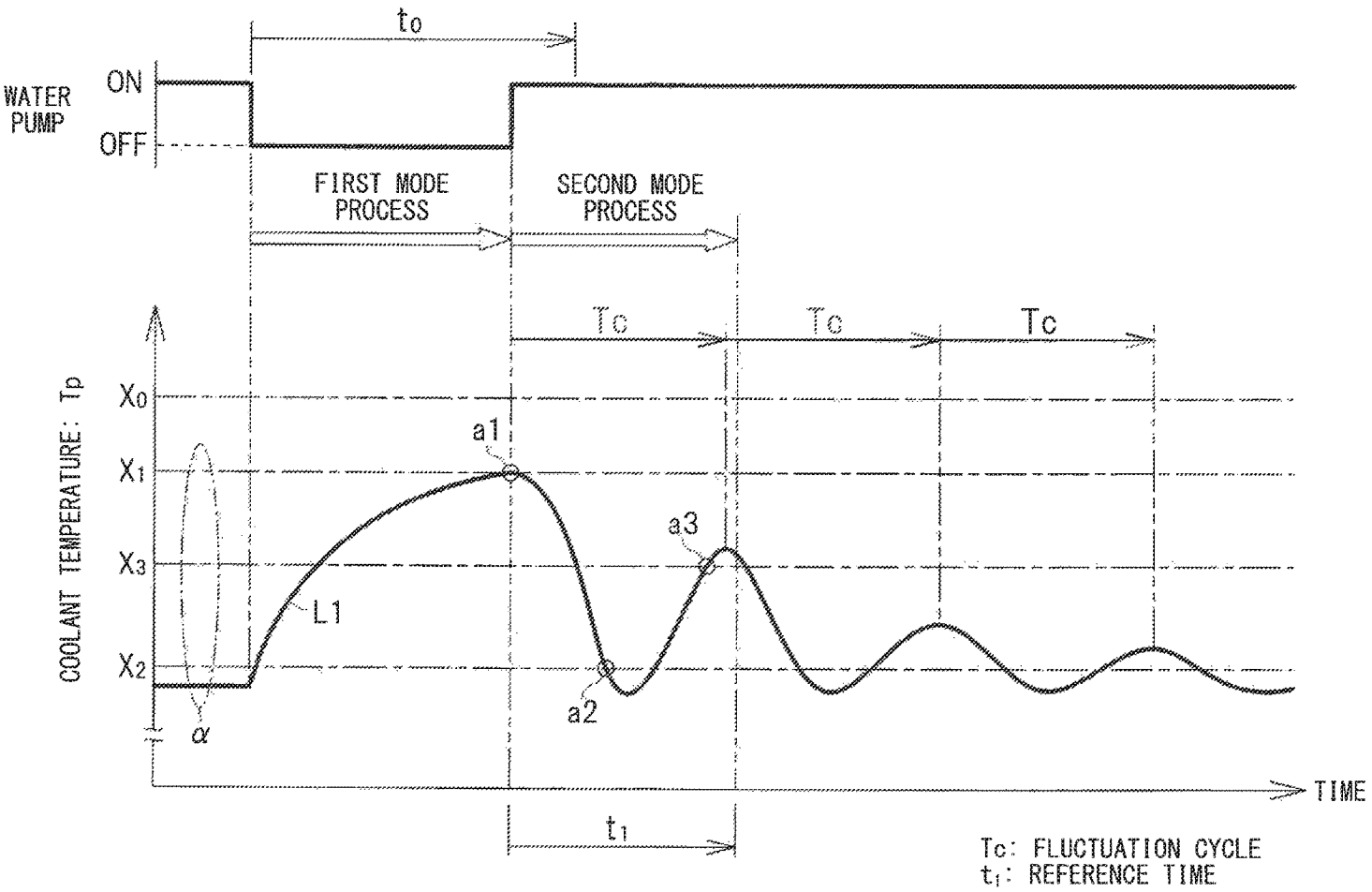
FIG. 5 is a diagram illustrating an example of a transition of a coolant temperature upon the abnormality diagnosing control.
Figure 6:
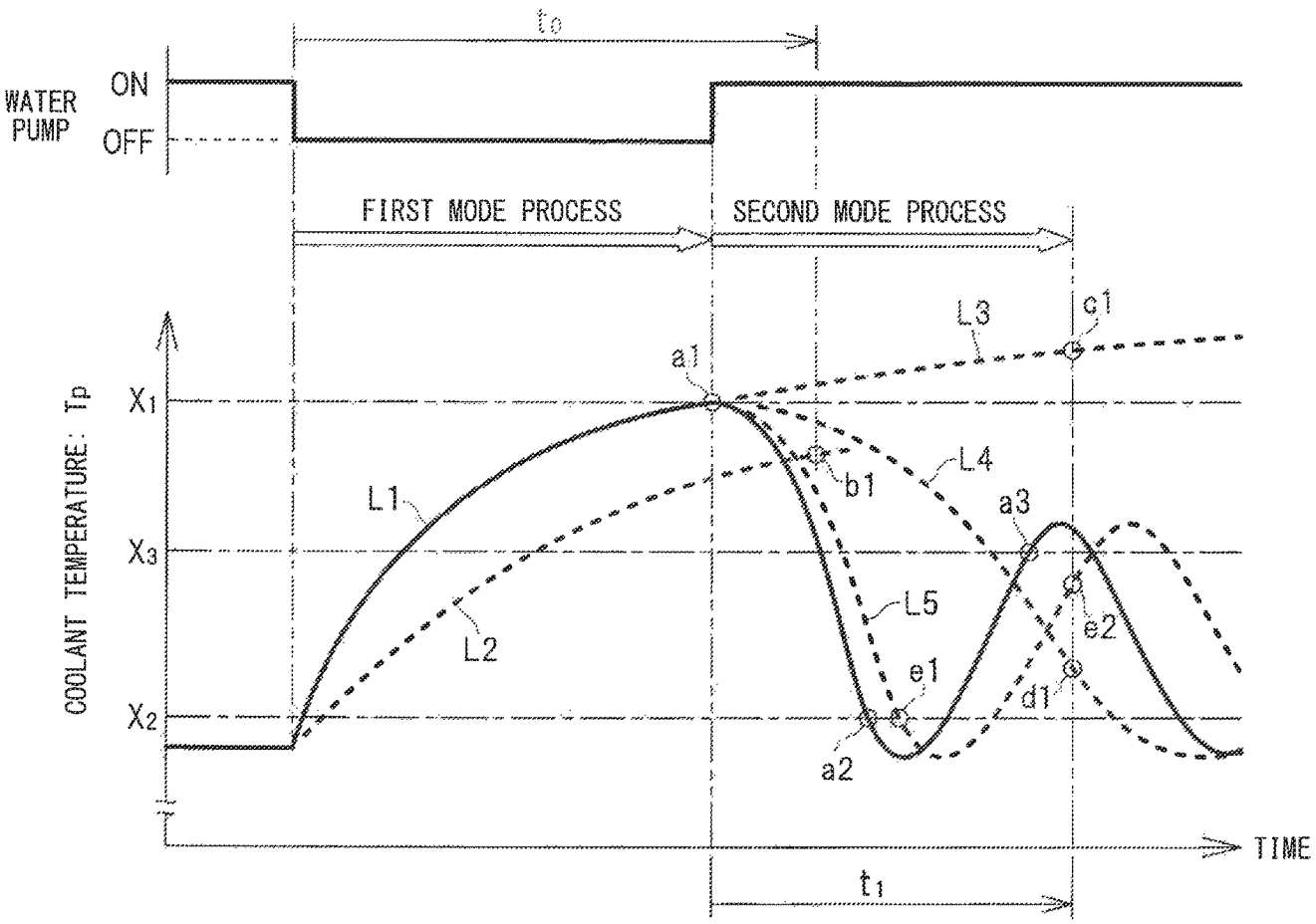
FIG. 6 is a diagram illustrating, in an enlarged fashion, a part of the transition of the coolant temperature illustrated in FIG. 5.

A description is given next of the abnormality diagnosing control that diagnoses the abnormality of the cooling system 13 according to one implementation. FIGS. 3 and 4 are each a flowchart illustrating one example of a procedure for carrying out the abnormality diagnosing control. Note that the flowcharts illustrated in FIGS. 3 and 4 are coupled to each other at parts denoted by reference signs A and B. FIG. 5 is a diagram illustrating an example of a transition of the coolant temperature Tp upon the abnormality diagnosing control. FIG. 6 is a diagram illustrating, in an enlarged fashion, a part of the transition of the coolant temperature Tp illustrated in FIG. 5. Note that a solid line L1 in FIGS. 5 and 6 illustrates the transition of the coolant temperature Tp when the cooling system 13 is normal, and dashed lines L2 to L5 in FIG. 6 each illustrate the transition of the coolant temperature Tp when the cooling system 13 is abnormal. It is to be also noted that "ON" and "OFF" denoted for the water pump 15 respectively refer to a situation where the water pump 15 is in operation and a situation where the operation of the water pump 15 is stopped.

Referring to FIG. 3, a determination may be made in step S10 as to whether the PCU 12 and the water pump 15 are normal. In one implementation, the determination in step S10 may be made on the basis of a malfunction code stored in the controller 30, or any other factor that indicates occurrence or possible occurrence of a malfunction. When the determination is made in step S10 that the PCU 12, the water pump 15, or both malfunctions (step S10: N), the flow may proceed to step S11 to end the routine without making an abnormality diagnosis of the cooling system 13. When the determination is made in step S10 that the PCU 12 and the water pump 15 are normal (step S10: Y), the flow may proceed to step S12. In step S12, a determination may be made as to whether the coolant temperature Tp in the PCU 12 is equal to or less than a start threshold $X_0$. When the determination is made in step S12 that the coolant temperature Tp is greater than the start threshold $X_0$ (step S12: N), the flow may proceed to step S11 to end the routine without making the abnormality diagnosis of the cooling system 13. Note that the abnormality diagnosing control is a control that actively increases the coolant temperature Tp as described later in greater detail. Hence, in one implementation, the abnormality diagnosing control may be discontinued to avoid an excessive increase in the coolant temperature Tp, when the coolant temperature Tp is determined as being already greater than the start threshold $X_0$.

When the determination is made in step S12 that the coolant temperature Tp is equal to or less than the start threshold $X_0$ (step S12: Y), the flow may proceed to step S13. In step S13, a first threshold $X_1$, a second threshold $X_2$, and a third threshold $X_3$ may be set on the basis of the coolant temperature Tp. In other words, the first threshold $X_1$, the second threshold $X_2$, and the third threshold $X_3$ may be set on the basis of the coolant temperature Tp that is before a later-described first mode process is started. As denoted by a reference sign a in FIG. 5, the second threshold $X_2$ may be set greater than the coolant temperature Tp that is before the first mode process is started, the third threshold $X_3$ may be set greater than the second threshold $X_2$, and the first threshold $X_1$ may be set greater than the third threshold $X_3$. Note that a difference in temperature between the first threshold $X_1$ and the coolant temperature Tp, a difference in temperature between the second threshold $X_2$ and the coolant temperature Tp, and a difference in temperature between the third threshold $X_3$ and the coolant temperature Tp may be constant irrespective of a temperature range of the coolant temperature Tp, or may be varied in accordance with the temperature range of the coolant temperature Tp.

Referring back to FIG. 3, the flow may proceed to step S14 after the first threshold $X_1$, the second threshold $X_2$, and the third threshold $X_3$ are set on the basis of the coolant temperature Tp in step S13. In step S14, the water pump 15 may be switched to a stopped state. Stopping the water pump 15 stops the circulation of the coolant, thereby allowing the coolant to be retained in the PCU 12 that may serve as an example of the heat-generating component. This in turn makes it possible to locally increase the coolant temperature Tp that is a temperature of the coolant that retains at the PCU 12, within the coolant that retains at each part of the cooling circuit 21. In other words, by stopping the water pump 15 in step S14, the first mode process may be started that increases the coolant temperature Tp.

When the coolant temperature Tp falls below the start threshold X0 upon the start of the first mode process as described above, the first mode process may be started to continue the diagnosis of the cooling system 13 (S12 to S14). In contrast, when the coolant temperature Tp is greater than the start threshold X0 upon the start of the first mode process, the first mode process may be cancelled to discontinue the diagnosis of the cooling system 13 (S12 to S11).

The flow may proceed to step S15 after the first mode process is started in step S14. In step S15, a determination may be made as to whether a time during which the water pump 15 is stopped, i.e., a stopped time, is equal to or less than a predetermined permissible time $t_0$. When the determination is made in step S15 that the stopped time of the water pump 15 is equal to or less than the permissible time $t_0$ (step S15: Y), the flow may proceed to step S16. In step S16, a determination may be made as to whether the coolant temperature Tp is equal to or greater than the first threshold $X_1$. When the determination is made in step S16 that the coolant temperature Tp is less than the first threshold $X_1$ (step S16: N), the flow may proceed back to step S15 to determine whether the stopped time of the water pump 15 is equal to or less than the permissible time $t_0$. The permissible time $t_0$ may refer to a time period during which the coolant temperature Tp does not increase excessively even when the circulation of the coolant is stopped from a viewpoint of proper functioning of the PCU 12, and may be set on the basis of experiment, simulation, or any other factor.

When the determination is made in step S15 that the stopped time of the water pump 15 is greater than the permissible time $t_0$ (step S15: N), the flow may proceed to step S17. In step S17, the water pump 15 may be switched to an operating state to discontinue the first mode process and to end the routine without making the abnormality diagnosis of the cooling system 13. In other words, a situation in which the stopped time of the water pump 15 is greater than the permissible time $t_0$ in step S15 is where the coolant temperature Tp does not exceed the first threshold $X_1$ within the permissible time $t_0$ (denoted by a reference sign b1), as denoted by the dashed line L2 of FIG. 6. In such a situation where the coolant temperature Tp does not increase sufficiently, performing of the abnormality diagnosis of the cooling system 13 is difficult. Hence, in one implementation, the routine may be ended without making the abnormality diagnosis of the cooling system 13.

Referring back to FIG. 3, when the determination is made in step S16 that the coolant temperature Tp is equal to or greater than the first threshold $X_1$ (step S16: Y), the flow may proceed to step S18. In step S18, the water pump 15 may be switched to the operating state. In other words, when the coolant temperature Tp reaches the first threshold $X_1$ (denoted by a reference sign a1) as denoted by the solid line L1 of FIG. 6, the water pump 15 may be switched to the operating state to resume the circulation of the coolant. This allows the coolant to flow out from the PCU 12 to the water pump 15 and flow into the PCU 12 from the radiator 16, thereby making it possible to cause the coolant temperature Tp in the PCU 12 to fluctuate periodically. In other words, by operating the water pump 15 in step S18, a second mode process may be started that causes the coolant temperature Tp to fluctuate at a predetermined fluctuation cycle Tc as illustrated in FIG. 5. In one implementation, the fluctuation cycle Tc of the coolant temperature Tp may be equivalent to a time period during which the coolant circulates through the cooling system 13 once.

When the coolant temperature Tp is exceeds the first threshold $X_1$ upon making the transition from the first mode process to the second mode process as described above, the transition is made to the second mode process to continue the diagnosis of the cooling system 13 (S16 to S18). In contrast, when the coolant temperature Tp is less than the first threshold $X_1$ upon making the transition from the first mode process to the second mode process, making of the transition to the second mode process may be cancelled to discontinue the diagnosis of the cooling system 13 (S16 to S15, S15 to S17, and S17 to S11).

Referring to FIG. 4, the flow may proceed to step S19 after the second mode process is started in step S18. In step S19, a determination may be made as to whether a time during which the water pump 15 is in operation, i.e., an operating time, is equal to or less than a predetermined reference time $t_1$. When the determination is made in step S19 that the operating time of the water pump 15 is equal to or less than the reference time $t_1$ (step S19: Y), the flow may proceed to step S20. In step S20, a determination may be made as to whether the coolant temperature Tp is equal to or less than the second threshold $X_2$. When the determination is made in step S20 that the coolant temperature Tp is greater than the second threshold $X_2$ (step S20: N), the flow may proceed back to step S19 to determine whether the operating time of the water pump 15 is equal to or less than the reference time $t_1$. The reference time $t_1$ may refer to a time period in which a predetermined time of margin is added to the expected fluctuation cycle Tc of the coolant temperature Tp, and may be set on the basis of experiment, simulation, or any other factor.

When the coolant temperature Tp exceeds the first threshold X1 upon making the transition from the first mode process to the second mode process as described above, the transition is made to the second mode process to continue the diagnosis of the cooling system 13 (S16 to S18). In contrast, when the coolant temperature Tp is less than the first threshold X1 upon making the transition from the first mode process to the second mode process, making of the transition to the second mode process may be cancelled to discontinue the diagnosis of the cooling system 13 (S16 to S15, S15 to S17, and S17 to S11).

Referring back to FIG. 4, when the determination is made in step S20 that the coolant temperature Tp is equal to or less than the second threshold $X_2$ (step S20: Y), the flow may proceed to step S22. In step S22, a determination may be made as to whether the operating time of the water pump 15 is equal to or less than the reference time $t_1$. When the determination is made in step S22 that the operating time of the water pump 15 is equal to or less than the reference time $t_1$ (step S22: Y), the flow may proceed to step S23. In step S23, a determination may be made as to whether the coolant temperature Tp is equal to or greater than the third threshold $X_3$. When the determination is made in step S23 that the coolant temperature Tp is less than the third threshold $X_3$ (step S23: N), the flow may proceed back to step S22 to determine whether the operating time of the water pump 15 is equal to or less than the reference time $t_1$.

When the determination is made in step S22 that the operating time of the water pump 15 is greater than the reference time $t_1$ (step S22: N), the flow may proceed to step S24. In step S24, information on attention may be displayed on the display 32 to the occupant, due to a possibility that the cooling circuit 21 is on the clogging side. In other words, a situation in which the operating time of the water pump 15 is greater than the reference time $t_1$ in step S22 is where the coolant temperature Tp falls below the second threshold $X_2$ within the reference time $t_1$ (denoted by a reference sign e1) but does not exceed the third threshold $X_3$ within the reference time $t_1$ (denoted by a reference sign e2), as denoted by the dashed line L5 of FIG. 6. In such a situation where the coolant temperature Tp does not exceed the third threshold $X_3$ within the reference time $t_r$ even with the circulation of the coolant by the driving of the water pump 15, the fluctuation cycle Tc of the coolant temperature Tp becomes longer than the reference time $t_1$. Hence, in one implementation, the controller 30 may make the diagnosis that the cooling system 13 is abnormal, since insufficiency of the circulation flow rate resulting from the clogging of the cooling circuit 21 is expected.

When the determination is made in step S23 that the coolant temperature Tp is equal to or greater than the third threshold $X_3$ (step S23: Y), the flow may proceed to step S25. In step S25, the controller 30 may make a diagnosis that the cooling system 13 is normal, and may end the routine. In other words, a situation in which the coolant temperature Tp is equal to or greater than the third threshold $X_3$ in step S23 is where, until the reference time $t_1$ elapses from the start of the second mode process, the coolant temperature Tp falls below the second threshold $X_2$ (denoted by a reference sign a2) and thereafter exceeds the third threshold $X_3$ (denoted by a reference sign a3), as denoted by the solid line L1 of FIG. 6. In such a situation where the coolant temperature Tp exceeds the third threshold $X_3$ within the reference time $t_1$ owing to the circulation of the coolant by the driving of the water pump 15, the fluctuation cycle Tc of the coolant temperature Tp becomes shorter than the reference time $t_1$. Hence, in one implementation, the controller 30 may make the diagnosis that the cooling system 13 is normal, since it is expected that the coolant circulates at a sufficient flow rate.

The controller 30 according to one implementation described above thus performs the first mode process that increases the coolant temperature Tp by stopping the water pump 15, and thereafter performs the second mode process that cause the coolant temperature Tp to fluctuate periodically by driving the water pump 15, upon the abnormality diagnosing control of the cooling system 13. Further, upon the second mode process, the controller 30 makes the diagnosis that the cooling system 13 is normal when the fluctuation cycle Tc of the coolant temperature Tp is shorter than the reference time $t_1$ in consideration of the sufficient circulation flow rate of the coolant, and makes the diagnosis that the cooling system 13 is abnormal when the fluctuation cycle Tc of the coolant temperature Tp is longer than the reference time $t_1$ in consideration of the insufficient circulation flow rate of the coolant.

According to one implementation described above, the abnormality of the cooling system 13 is detected on the basis of the fluctuation cycle Tc of the coolant temperature Tp, instead of detecting the abnormality of the cooling system 13 on the basis of an excessive increase in the coolant temperature Tp. Hence, it is possible to diagnose the abnormality of the cooling system 13 at an early stage, and to increase reliability of the cooling system 13 accordingly. Further, the abnormality of the cooling system 13 is detected on the basis of the fluctuation cycle Tc of the coolant temperature Tp, making it possible to perform the abnormality diagnosing control with an extremely simple configuration. Hence, it is possible to restrain costs of the cooling apparatus for vehicle 10.

It is to be noted that FIG. 1 illustrates a non-limiting example in which the radiator 16 is mounted at a front part of the vehicle 11 and the PCU 12 is mounted at a rear part of the vehicle 11. Separating the positions at which the PCU 12 and the radiator 16 are disposed in this way makes it easier to widen a difference between the coolant temperature Tp of the PCU 12 and a temperature of the coolant at any other part. The positions of respective elements of the cooling system 13, however, are not limited thereto. In an alternative implementation, the PCU 12 may be so mounted as to be located close to the radiator 16, the reservoir tank 14, or both. In another alternative implementation, all of the elements of the cooling system 13 may be mounted at a front part of the vehicle 11, or may be mounted at a rear part of the vehicle 11.

[Other Implementations]

Figure 7:
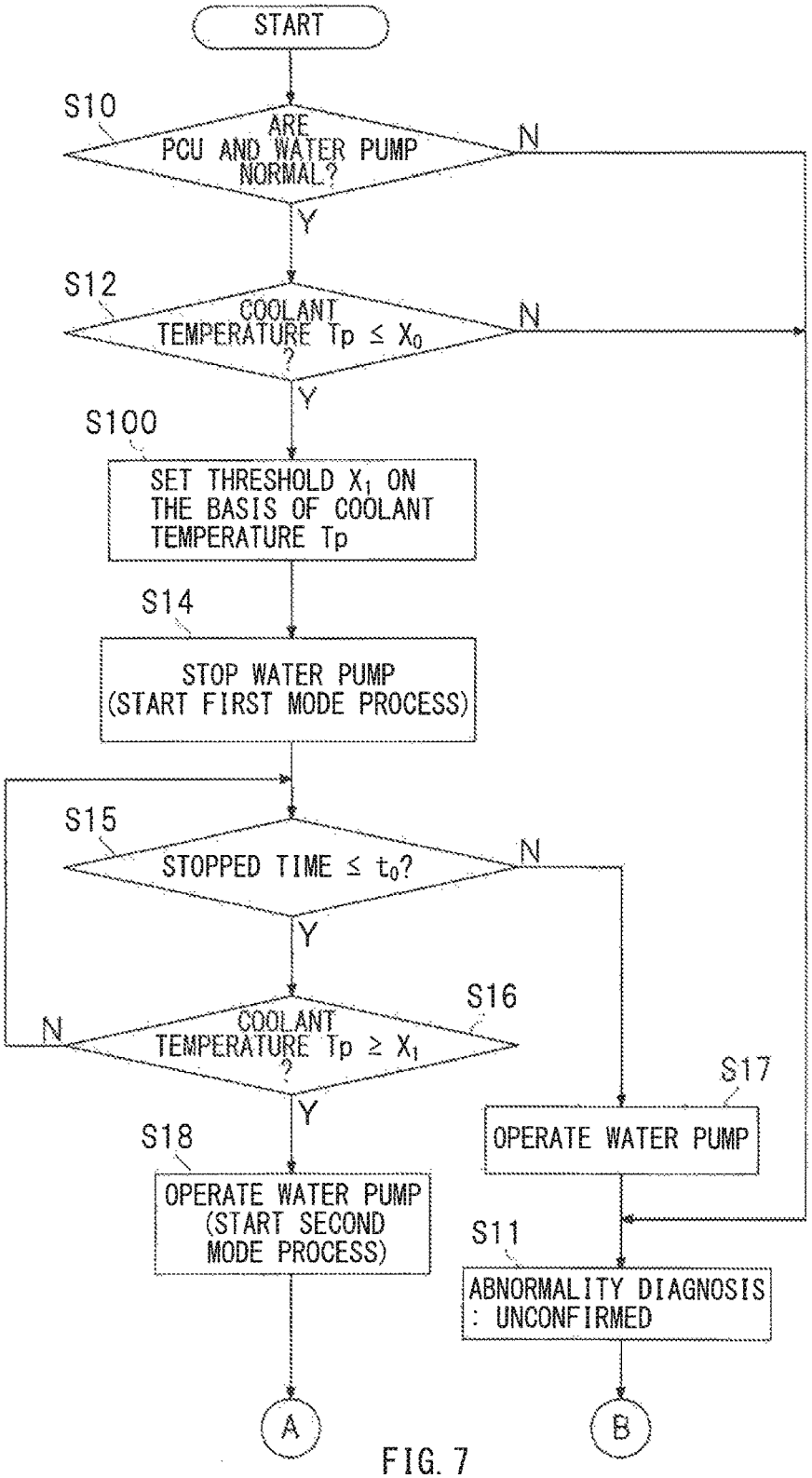
FIG. 7 is a flowchart illustrating another example of the procedure for carrying out the abnormality diagnosing control.
Figure 8:
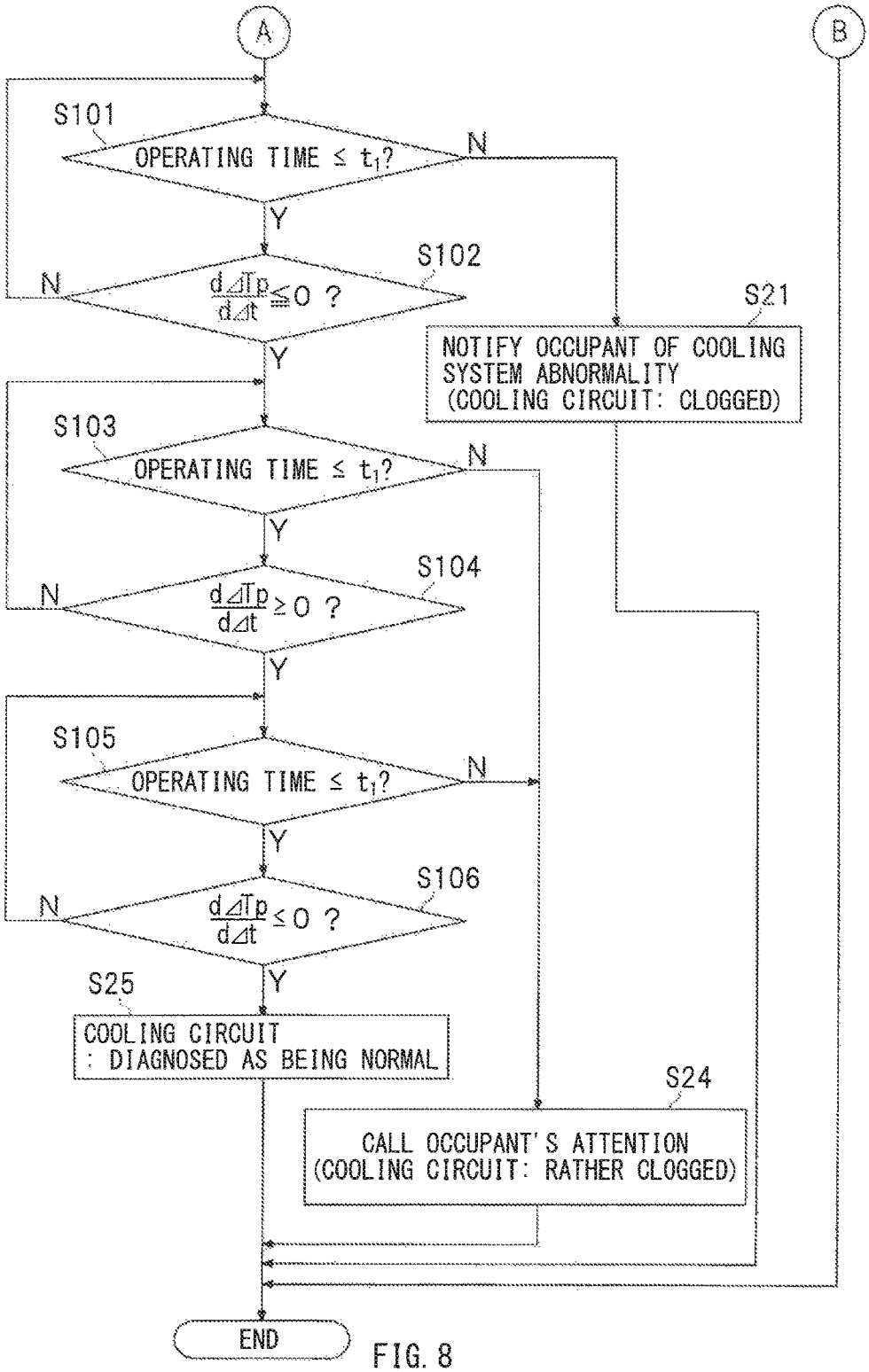
FIG. 8 is a flowchart illustrating another example of the procedure for carrying out the abnormality diagnosing control.
Figure 9:
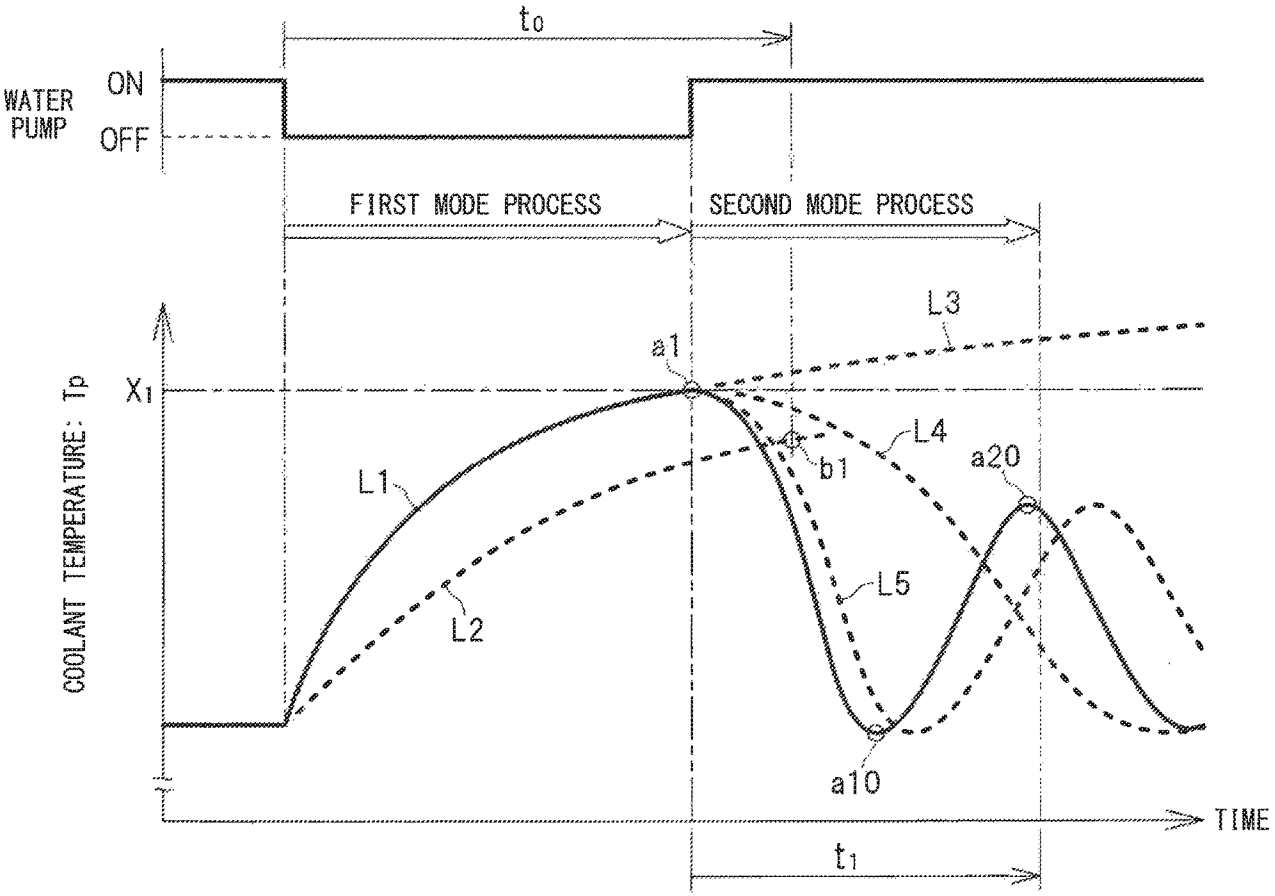
FIG. 9 is a diagram illustrating, in an enlarged fashion, a part of the transition of the coolant temperature illustrated in FIG. 5.

In one implementation described above, the coolant temperature Tp of the PCU 12 is compared with the a threshold such as the second threshold $X_2$ and the third threshold $X_3$ to determine whether the fluctuation cycle Tc of the coolant temperature Tp is shorter than the reference time $t_1$. A method on which the determination on the fluctuation cycle Tc of the coolant temperature Tp is based, however, is not limited thereto. In one implementation, the fluctuation cycle Tc of the coolant temperature Tp may be based on any other method. FIGS. 7 and 8 are each a flowchart illustrating another example of the procedure for carrying out the abnormality diagnosing control. Note that the flowcharts illustrated in FIGS. 7 and 8 are coupled to each other at parts denoted by reference signs A and B. It is to be also noted that, in FIGS. 7 and 8, steps similar to those of FIGS. 3 and 4 are denoted with the same reference numerals to avoid redundant description thereof. FIG. 9 is a diagram illustrating, in an enlarged fashion, a part of the transition of the coolant temperature Tp illustrated in FIG. 5, and illustrates the part same as that of FIG. 6. Note that, in FIG. 9, a solid line, dashed lines, time, and thresholds that are similar to those of FIG. 6 are denoted with the same reference numerals to avoid redundant description thereof.

Referring to FIG. 7, when the determination is made in step S12 that the coolant temperature Tp is equal to or less than the start threshold $X_0$ (step S12: Y), the flow may proceed to step S100. In step S100, the first threshold $X_1$ may be set on the basis of the coolant temperature Tp. The flow may proceed to step S14 after the first threshold $X_1$ is set in step S100. In step S14, the water pump 15 may be switched to the stopped state to start the first mode process. When the determination is made in step S16, after the start of the first mode process, that the coolant temperature Tp is equal to or greater than the first threshold $X_1$ (step S16: Y), the flow may proceed to step S18. In step S18, the water pump 15 may be switched to the operating state to start the second mode process.

Referring to FIG. 8, the flow may proceed to step S101 after the second mode process is started in step S18. In step S101, a determination may be made as to whether the operating time of the water pump 15 is equal to or less than the predetermined reference time $t_1$. When the determination is made in step S101 that the operating time of the water pump 15 is equal to or less than the reference time $t_1$ (step S101: Y), the flow may proceed to step S102. In step S102, a determination may be made as to whether a differential value of a variation amount ΔTp of the coolant temperature Tp is minus. When the determination is made in step S102 that the differential value of the variation amount ΔTp is plus (step S102: N), i.e., when the coolant temperature Tp continues to increase, the flow may proceed back to step S101 to determine whether the operating time of the water pump 15 is equal to or less than the reference time $t_1$.

When the determination is made in step S101 that the operating time of the water pump 15 is greater than the reference time $t_1$ (step S101: N), the flow may proceed to step S21. In step S21, the information on the abnormality of the cooling system 13 may be displayed on the display 32 to the occupant, due to the possibility of clogging of the cooling circuit 21. In other words, a situation in which the operating time of the water pump 15 is greater than the reference time $t_1$ in step S101 is where the coolant temperature Tp does not start to decrease until the reference time $t_1$ elapses from the start of the second mode process, as denoted by the dashed line L3 of FIG. 9. In such a situation where the coolant temperature Tp does not decrease within the reference time $t_1$ even with the circulation of the coolant by the driving of the water pump 15, the fluctuation cycle Tc of the coolant temperature Tp becomes longer than the reference time $t_1$. Hence, in one implementation, the controller 30 may make the diagnosis that the cooling system 13 is abnormal, since the insufficiency of the circulation flow rate resulting from the clogging of the cooling circuit 21 is expected.

When the determination is made in step S102 that the differential value of the variation amount ΔTp is minus (step S102: Y), i.e., when the coolant temperature Tp has made a transition from increase to decrease, the flow may proceed to step S103. In step S103, a determination may be made as to whether the operating time of the water pump 15 is equal to or less than the reference time $t_1$. When the determination is made in step S103 that the operating time of the water pump 15 is equal to or less than the reference time $t_1$ (step S103: Y), the flow may proceed to step S104. In step S104, a determination may be made as to whether the differential value of the variation amount ΔTp of the coolant temperature Tp is plus. When the determination is made in step S104 that the differential value of the variation amount ΔTp is minus (step S104: N), i.e., when the coolant temperature Tp continues to decrease, the flow may proceed back to step S103 to determine whether the operating time of the water pump 15 is equal to or less than the reference time $t_1$.

When the determination is made in step S103 that the operating time of the water pump 15 is greater than the reference time $t_1$ (step S103: N), the flow may proceed to step S24. In step S24, the information on attention may be displayed on the display 32 to the occupant, due to the possibility that the cooling circuit 21 is on the clogging side. In other words, a situation in which the operating time of the water pump 15 is greater than the reference time $t_1$ in step S103 is where the coolant temperature Tp does not make a transition from decrease to increase until the reference time $t_1$ elapses from the start of the second mode process, as denoted by the dashed line L4 of FIG. 9. In such a situation where the coolant temperature Tp does not make the transition from decrease to increase within the reference time $t_1$ even with the circulation of the coolant by the driving of the water pump 15, the fluctuation cycle Tc of the coolant temperature Tp becomes longer than the reference time $t_1$. Hence, in one implementation, the controller 30 may make the diagnosis that the cooling system 13 is abnormal, since the insufficiency of the circulation flow rate resulting from the clogging of the cooling circuit 21 is expected.

When the determination is made in step S104 that the differential value of the variation amount ΔTp is plus (step S104: Y), i.e., when the coolant temperature Tp has made the transition from decrease to increase, the flow may proceed to step S105. In step S105, a determination may be made as to whether the operating time of the water pump 15 is equal to or less than the reference time $t_1$. When the determination is made in step S105 that the operating time of the water pump 15 is equal to or less than the reference time $t_1$ (step S105: Y), the flow may proceed to step S106. In step S106, a determination may be made as to whether the differential value of the variation amount ΔTp of the coolant temperature Tp is minus. When the determination is made in step S106 that the differential value of the variation amount ΔTp is plus (step S106: N), i.e., when the coolant temperature Tp continues to increase, the flow may proceed back to step S105 to determine whether the operating time of the water pump 15 is equal to or less than the reference time $t_1$.

When the determination is made in step S105 that the operating time of the water pump 15 is greater than the reference time $t_1$ (step S105: N), the flow may proceed to step S24. In step S24, the information on attention may be displayed on the display 32 to the occupant, due to the possibility that the cooling circuit 21 is on the clogging side. In other words, a situation in which the operating time of the water pump 15 is greater than the reference time $t_1$ in step S105 is where the coolant temperature Tp makes the transition from decrease to increase but thereafter does not make the transition from increase to decrease until the reference time $t_1$ elapses from the start of the second mode process, as denoted by the dashed line L5 of FIG. 9. In such a situation where the coolant temperature Tp does not make the transition from increase to decrease within the reference time $t_1$ even with the circulation of the coolant by the driving of the water pump 15, the fluctuation cycle Tc of the coolant temperature Tp becomes longer than the reference time $t_1$. Hence, in one implementation, the controller 30 may make the diagnosis that the cooling system 13 is abnormal, since the insufficiency of the circulation flow rate resulting from the clogging of the cooling circuit 21 is expected.

When the determination is made in step S106 that the differential value of the variation amount ΔTp is minus (step S106: Y), i.e., when the coolant temperature Tp has made the transition from increase to decrease, the flow may proceed to step S25. In step S25, the controller 30 may make the diagnosis that the cooling system 13 is normal, and may end the routine. In other words, a situation in which the coolant temperature Tp makes the transition from increase to decrease in step S106 is where, until the reference time $t_1$ elapses from the start of the second mode process, the coolant temperature Tp makes the transition from decrease to increase (denoted by a reference sign a10) and thereafter makes the transition from increase to decrease (denoted by a reference sign a20), as denoted by the solid line L1 of FIG. 9. In such a situation where, within the reference time $t_1$, the coolant temperature Tp makes the transition from decrease to increase and thereafter makes the transition from increase to decrease owing to the circulation of the coolant by the driving of the water pump 15, the fluctuation cycle Tc of the coolant temperature Tp becomes shorter than the reference time $t_1$. Hence, in one implementation, the controller 30 may make the diagnosis that the cooling system 13 is normal, since it is expected that the coolant circulates at the sufficient flow rate.

Although some implementations of the technology have been described in the foregoing with reference to the accompanying drawings, the technology is by no means limited to the implementations described above, and is variously modifiable without departing from the scope as defined by the appended claims. For example, the cooling apparatus for vehicle 10 is applied to the vehicle 11 as the hybrid vehicle in any of the foregoing implementations. The vehicle 11 to which the cooling apparatus for vehicle 10 is applied, however, is not limited thereto. The cooling apparatus for vehicle 10 may be applied to any vehicle 11 as long as the vehicle 11 includes the cooling system 13 that cools any heat-generating component. In addition, the PCU 12 that includes the inverter 24 and the converter 25 is given as an example of the heat-generating component in any of the foregoing implementations. The heat-generating component as a target to be cooled, however, is not limited thereto. Non-limiting examples of the heat-generating component as the cooling target may include the inverter 24 alone and the converter 25 alone. Non-limiting examples of the heat-generating component may also include an electric motor and an engine. Further, one heat-generating component is provided for the cooling system 13 in an illustrated implementation. The number of heat-generating components provided for the cooling system 13, however, is not limited thereto. In an alternative implementation, a plurality of heat-generating components may be provided for one cooling system 13.

Further, a temperature of the coolant itself that flows in the PCU 12 is detected as the coolant temperature Tp of the PCU 12 in any of the foregoing implementations. A temperature as a target to be detected, however, is not limited thereto. Any other temperature that allows for estimation of the temperature of the coolant that flows in the PCU 12 may be detected. In an alternative implementation, a temperature of a housing of the PCU 12 may be utilized as the coolant temperature Tp. In a further alternative implementation, a temperature of one or both of the inverter 24 and the converter 25 provided in the PCU 12 may be utilized as the coolant temperature Tp. In a yet further alternative implementation, a temperature of any of various devices that are provided in the inverter 24 and the converter 25 and generate heat, such as the switching device and a reactor, may be utilized as the coolant temperature Tp. Moreover, in one implementation described above, the variation amount $\Delta Tp$ of the coolant temperature Tp is differentiated to determine the increase or the decrease of the coolant temperature Tp. A method of determining the increase or the decrease of the coolant temperature Tp, however, is not limited thereto. In an alternative implementation, the increase or the decrease of the variation amount $\Delta Tp$ may be calculated for each predetermined time $t_0$ determine the increase or the decrease of the coolant temperature Tp.

The controller 30 illustrated in FIG. 2 is implementable by circuitry including at least one semiconductor integrated circuit such as at least one processor (e.g., a central processing unit (CPU)), at least one application specific integrated circuit (ASIC), and/or at least one field programmable gate array (FPGA). At least one processor is configurable, by reading instructions from at least one machine readable tangible medium, to perform all or a part of functions of the controller 30. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the nonvolatile memory may include a ROM and a NVRAM. The ASIC is an integrated circuit (IC) customized to perform, and the FPGA is an integrated circuit designed to be configured after manufacturing in order to perform, all or a part of the functions of the controller 30 illustrated in FIG. 2.

It should be appreciated that modifications and alterations may be made by persons skilled in the art without departing from the scope as defined by the appended claims. The technology is intended to include such modifications and alterations in so far as they fall within the scope of the appended claims or the equivalents thereof.

The invention claimed is:

1. A cooling apparatus for a vehicle, the apparatus comprising: a cooling system that cools a heat-generating component by a coolant, and includes a cooling circuit in which the coolant circulates; a coolant pump that is provided in the cooling circuit, and causes the coolant to circulate in the cooling circuit; and a diagnostic controller that diagnoses an abnormality of the cooling system on a basis of a coolant temperature of the coolant that cools the heat-generating component, the diagnostic controller performing a first mode process and a second mode process, the first mode process increasing the coolant temperature by stopping the coolant pump, the second mode process being performed after the first mode process is performed and causing the coolant temperature to fluctuate periodically by driving the coolant pump, and the diagnostic controller, upon the second mode process, making a diagnosis that the cooling system is normal on a condition that a predetermined fluctuation cycle of the fluctuation of the coolant temperature is shorter than a reference time, and making a diagnosis that the cooling system is abnormal, in which there is expected to be an insufficiency in circulation flow rate of the coolant, on a condition that the cycle of the fluctuation of the coolant temperature is longer than the reference time.

2. The cooling apparatus for the vehicle according to claim 1, wherein the diagnostic controller enables an initiation of the first mode process on a condition that the coolant temperature falls below a first mode process start threshold, and precludes initiation of the first mode process on a condition that the coolant temperature is greater than the first mode process start threshold.

3. The cooling apparatus for the vehicle according to claim 1, wherein the diagnostic controller continues the diagnosis of the cooling system by making a transition from the first mode process to the second mode process on a condition that the coolant temperature exceeds a first threshold upon making the transition from the first mode process to the second mode process, and discontinues the diagnosis of the cooling system by cancelling the transition from the first mode process to the second mode process on a condition that the coolant temperature is less than the first threshold upon making the transition from the first mode process to the second mode process.

4. The cooling apparatus for the vehicle according to claim 2, wherein the diagnostic controller continues the diagnosis of the cooling system by making a transition from the first mode process to the second mode process on a condition that the coolant temperature exceeds a first threshold upon making the transition from the first mode process to the second mode process, and discontinues the diagnosis of the cooling system by cancelling the transition from the first mode process to the second mode process on a condition that the coolant temperature is less than the first threshold upon making the transition from the first mode process to the second mode process.

5. The cooling apparatus for the vehicle according to claim 1, wherein the condition that the cycle of the fluctuation of the coolant temperature is shorter than the reference time comprises a condition that, until the reference time elapses from start of the second mode process, the coolant temperature falls below a second threshold and thereafter exceeds a third threshold that is greater than the second threshold.

6. The cooling apparatus for the vehicle according to claim 2, wherein the condition that the cycle of the fluctuation of the coolant temperature is shorter than the reference time comprises a condition that, until the reference time elapses from start of the second mode process, the coolant temperature falls below a second threshold and thereafter exceeds a third threshold that is greater than the second threshold.

7. The cooling apparatus for the vehicle according to claim 1, wherein the condition that the cycle of the fluctuation of the coolant temperature is longer than the reference time comprises a condition that, until the reference time elapses from start of the second mode process, the coolant temperature does not fall below a second threshold, or a condition that, until the reference time elapses from the start of the second mode process, the coolant temperature falls below the second threshold but does not thereafter exceed a third threshold that is greater than the second threshold.

8. The cooling apparatus for the vehicle according to claim 2, wherein the condition that the cycle of the fluctuation of the coolant temperature is longer than the reference time comprises a condition that, until the reference time elapses from start of the second mode process, the coolant temperature does not fall below a second threshold, or a condition that, until the reference time elapses from the start of the second mode process, the coolant temperature falls below the second threshold but does not thereafter exceed a third threshold that is greater than the second threshold.

9. The cooling apparatus for the vehicle according to claim 1, wherein the condition that the cycle of the fluctuation of the coolant temperature is shorter than the reference time comprises a condition that, until the reference time elapses from start of the second mode process, the coolant temperature makes a transition from decrease to increase and thereafter makes a transition from the increase to decrease.

10. The cooling apparatus for the vehicle according to claim 2, wherein the condition that the cycle of the fluctuation of the coolant temperature is shorter than the reference time comprises a condition that, until the reference time elapses from start of the second mode process, the coolant temperature makes a transition from decrease to increase and thereafter makes a transition from the increase to decrease.

11. The cooling apparatus for the vehicle according to claim 1, wherein the condition that the cycle of the fluctuation of the coolant temperature is longer than the reference time comprises a condition that, until the reference time elapses from start of the second mode process, the coolant temperature does not decrease, a condition that, until the reference time elapses from the start of the second mode process, the coolant temperature does not make a transition from decrease to increase, or a condition that, until the reference time elapses from the start of the second mode process, the coolant temperature makes the transition from the decrease to the increase but does not thereafter make a transition from the increase to decrease.

12. The cooling apparatus for the vehicle according to claim 2, wherein the condition that the cycle of the fluctuation of the coolant temperature is longer than the reference time comprises a condition that, until the reference time elapses from start of the second mode process, the coolant temperature does not decrease, a condition that, until the reference time elapses from the start of the second mode process, the coolant temperature does not make a transition from decrease to increase, or a condition that, until the reference time elapses from the start of the second mode process, the coolant temperature makes the transition from the decrease to the increase but does not thereafter make a transition from the increase to decrease.

13. The cooling apparatus for the vehicle according to claim 3, wherein the diagnostic controller sets the first threshold on a basis of the coolant temperature present before the first mode process is started.

14. The cooling apparatus for the vehicle according to claim 4, wherein the diagnostic controller sets the first threshold on a basis of the coolant temperature present before the first mode process is started.

15. The cooling apparatus for the vehicle according to claim 5, wherein the diagnostic controller sets the second threshold and the third threshold on a basis of the coolant temperature present before the first mode process is started.

16. The cooling apparatus for the vehicle according to claim 6, wherein the diagnostic controller sets the second threshold and the third threshold on a basis of the coolant temperature present before the first mode process is started.

17. The cooling apparatus for the vehicle according to claim 7, wherein the diagnostic controller sets the second threshold and the third threshold on a basis of the coolant temperature present before the first mode process is started.

18. The cooling apparatus for the vehicle according to claim 8, wherein the diagnostic controller sets the second threshold and the third threshold on a basis of the coolant temperature present before the first mode process is started.

19. The cooling apparatus for the vehicle according to claim 1, wherein the diagnostic controller monitors for a predetermined time of pump stoppage, and the second mode process is initiated upon confirmation that the predetermined time of pump stoppage has not been exceeded.

20. The cooling apparatus for the vehicle according to claim 1, wherein the reference time is equal to the predetermined fluctuation cycle time plus a predetermined added margin time.

* * * * *